US007704197B2

(12) United States Patent
Yu

(10) Patent No.: US 7,704,197 B2
(45) Date of Patent: Apr. 27, 2010

(54) DUMBBELL WEIGHT SELECTION STRUCTURE

(76) Inventor: Yu-Chen Yu, 1F., No. 16, La. 429, Sec. 2, Dongda Rd., Hsinchu 300 (TW)

( * ) Notice: Subject to any disclaimer, the term of this patent is extended or adjusted under 35 U.S.C. 154(b) by 168 days.

(21) Appl. No.: 11/936,841

(22) Filed: Nov. 8, 2007

(65) Prior Publication Data

US 2009/0124470 A1 May 14, 2009

(51) Int. Cl.
*A63B 21/072* (2006.01)
*A63B 21/075* (2006.01)

(52) U.S. Cl. ..... 482/108

(58) Field of Classification Search ..... 482/92–94, 482/98, 104, 106–109, 908, 99; *A63B 21/072, A63B 21/075*
See application file for complete search history.

(56) References Cited

U.S. PATENT DOCUMENTS 4,529,198 A * 7/1985 Hettick, Jr. ..... 482/104
7,473,211 B2 * 1/2009 Lee ..... 482/97
2002/0055426 A1 * 5/2002 Krull ..... 482/98
2008/0305936 A1 * 12/2008 Cao ..... 482/98

* cited by examiner

*Primary Examiner*—Loan H Thanh
*Assistant Examiner*—Oren Ginsberg
(74) *Attorney, Agent, or Firm*—Chun-Ming Shih

(57) ABSTRACT

A dumbbell weight selection structure includes an extension rod disposed at any end of a handle unit. The extension rod is disposed with a selection unit, which contains a selection mechanism and multiple weight plates are disposed thereon. The selection mechanism includes a slide plate linked to drive the selection plate set to travel. A locking hole to insert by the selection plate set is disposed at where appropriately on each weight plate. The slide plate is moved to change connection of the selection plate set corresponding to the locking holes of multiple weight plates to select quantity of weight plates to be attached to the dumbbell as desired for achieving discretional adjustment of the overall weight of the dumbbell.

12 Claims, 8 Drawing Sheets

DUMBBELL WEIGHT SELECTION STRUCTURE

BACKGROUND OF THE INVENTION (a) Field of the Invention

The present invention is related to a dumbbell weight selection structure of a fitness exerciser, and more particularly to one that allows user to adjust the weight to be attached as desired depending on individual needs.

(b) Description of the Prior Art

A dumbbell for fitness or for sports is usually related to a single structure with a given weight and a user may select to purchase a dumbbell of proper weight that suits the user best; however, a dumbbell with a fixed weight is not ideal for multiple users. For example, in a family, physical build up and/or physical strength may vary among family members. Unless multiple dumbbells of different weights are purchased so that each family member has the dumbbell of the weight meets individual need, it is impossible for a single dumbbell of a fixed weight to satisfy the needs of each and all family members.

SUMMARY OF THE INVENTION

The primary purpose of the present invention is to provide to provide a dumbbell weight selection structure with the weight adjustable for the user to easily select a weight that fits him/her best simply by dialing a slide board to a proper position for selecting the quantity of the plate weights to be attached to the dumbbell as desired.

To achieve the purpose, a dumbbell of the present invention includes a handle unit, both outer ends of the handle unit are respectively provided with an extension rod, a selection unit is disposed to the extension rod; the selection unit further contains a selection mechanism and multiple plate weights; wherein the selection mechanism includes a slide plate; the slide plate is connected to a slip-on clip; the slide clip drives a guide plate to travel; the guide plate is wrapped up with a connection cord and a selection plate set; and the connection cord is linked to a bottom of the slip-on clip at where the connection cord and a specific end of the selection plate set are connected to each other. Accordingly, when the slide plate moves; it is linked to and drives the slip-on clip and the connection cord to travel along with the selection set unit. A locking opening to receive the selection plate is disposed in the center of the weight plate. Multiple weight plates are erected in parallel with one another and then are covered up by the selection unit, a connection relation between the selection plate set corresponding to the locking hole of multiple weight plates is changed according to the present invention to allow discretional selection of the number of weight plates to be attached to the dumbbell for achieving the purpose of adjusting the overall weight of the dumbbell as desired.

DETAILED DESCRIPTION OF THE PREFERRED EMBODIMENTS

Figure 1:
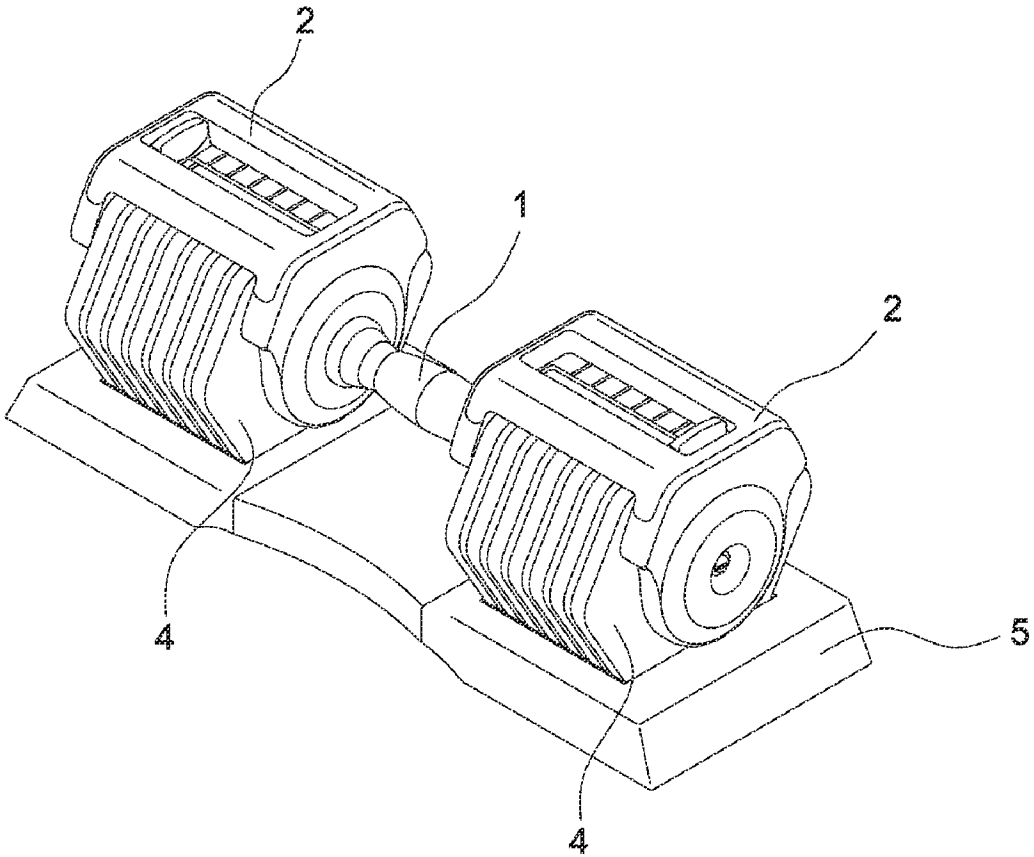
FIG. 1 is a perspective view of the present invention.

Referring to FIG. 1, a dumbbell weight selection structure of the present invention is essentially comprised of a handle unit 1, a selection unit 2, one or a plurality of weight plate 4, and a base 5.

One end or a plurality of ends of the handle unit 1 is connected to the selection unit; the selection unit selects quantity of weight plate and has the select weight plate attached to the selection unit; and the base 5 is disposed for placement of the dumbbell.

Figure 2:
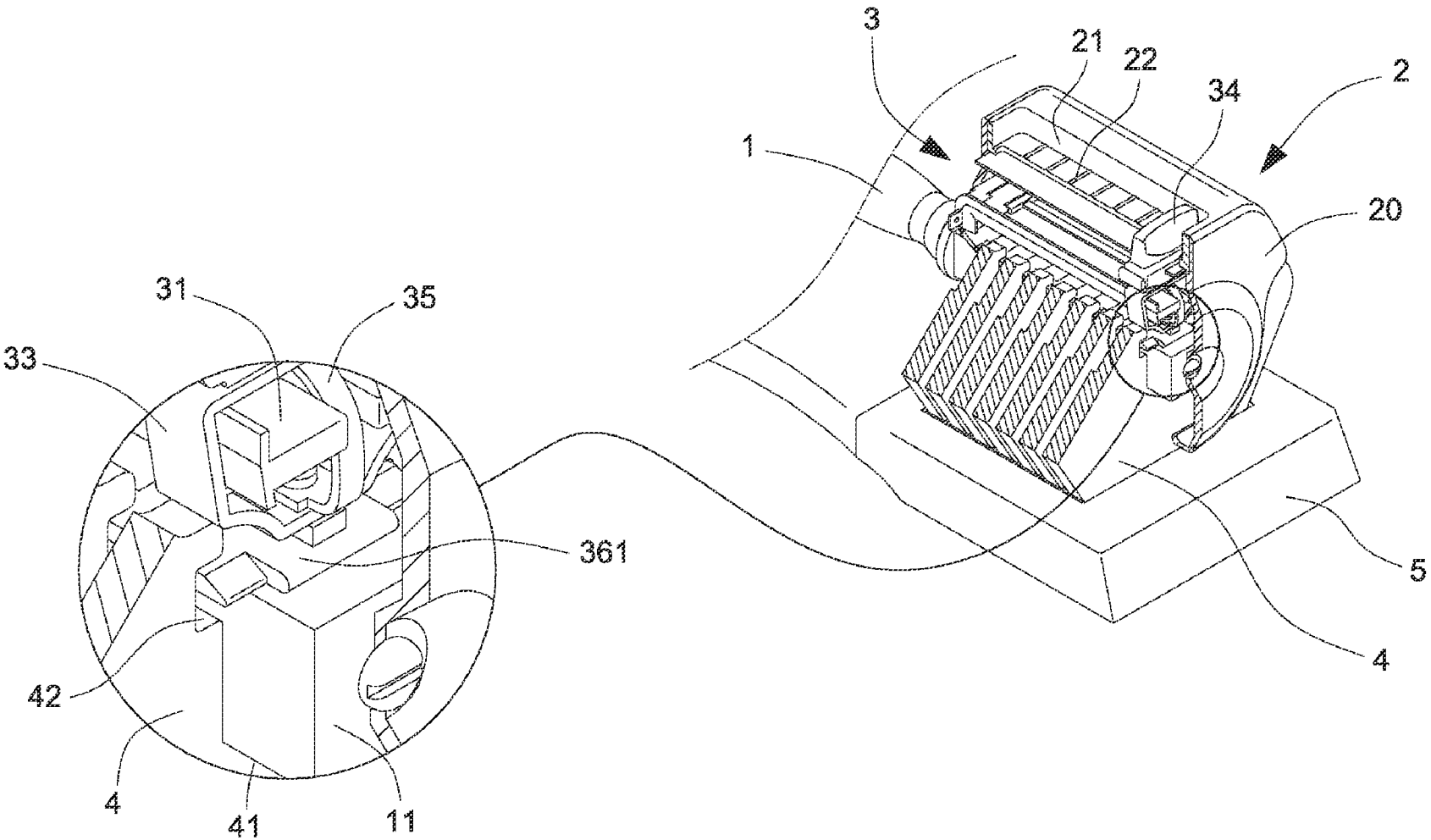
FIG. 2 is a sectional view showing a local part of the present invention.
Figure 3:
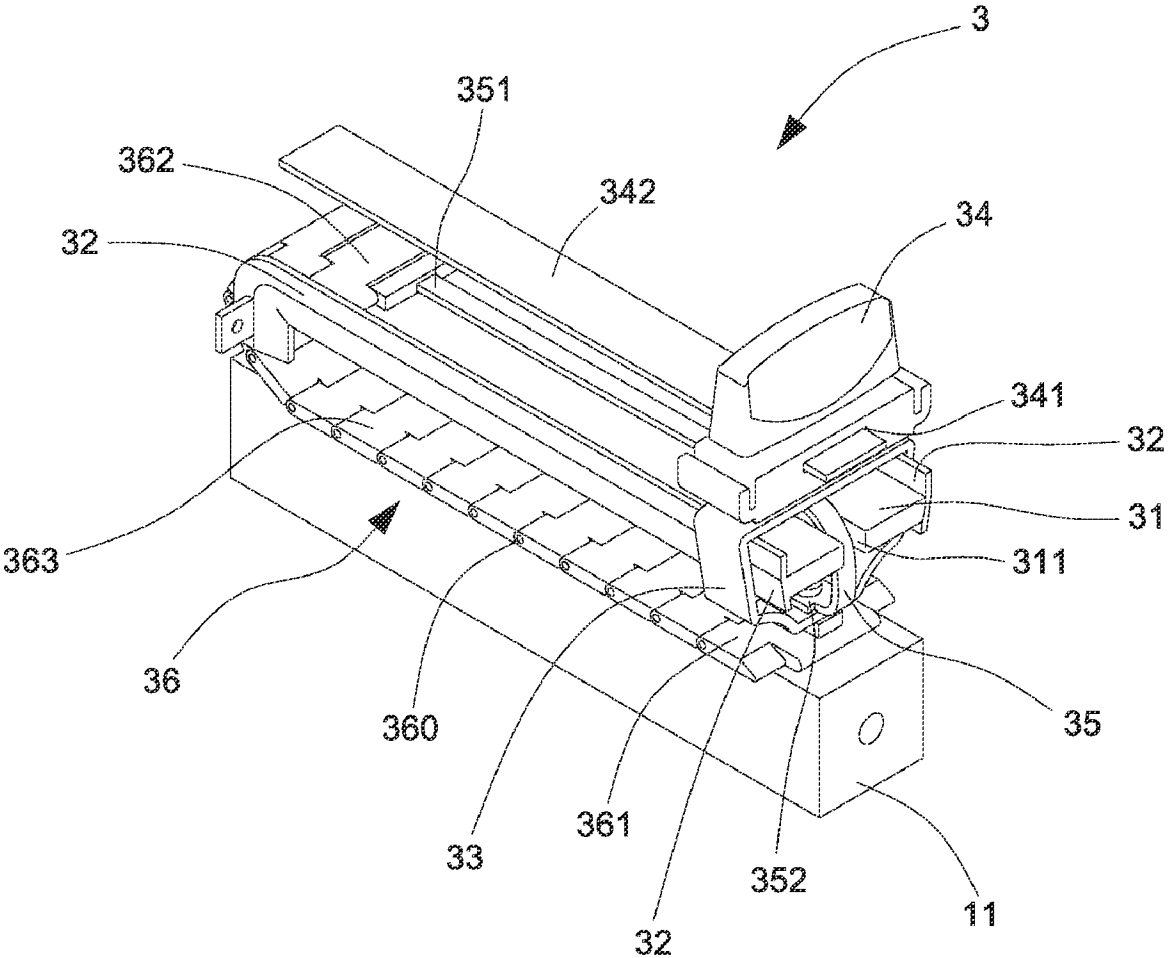
FIG. 3 is a perspective showing a selection mechanism in the present invention.
Figure 4:
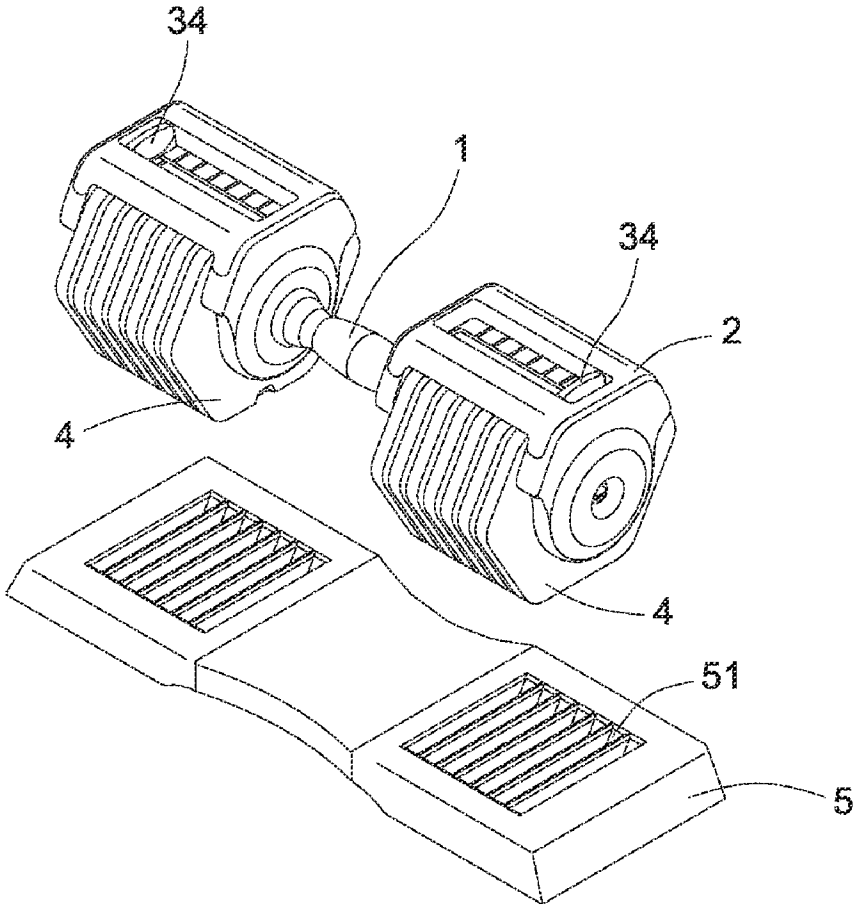
FIG. 4 is a schematic view showing an operating status of the present invention.

Now referring to FIGS. 2 and 3, an extension rod 11 is disposed to one end of the handle unit 1; and the selection unit 2 is disposed on the extension rod 11. The selection unit 2 includes a casing 20; a chute 21 is disposed at where appropriately on the casing 20; and a selection mechanism 3 is disposed on the chute 21. The selection mechanism 3 includes a guide plate 31; the guide plate 31 is laterally disposed in parallel with the extension rod 11; both side edges of the guide plate 31 are respectively disposed with a rail 32 in opposite to each other; a slip-on clip 33 is externally inserted onto the rail to travel by sliding relatively to the rail 32; a slide plate 34 is disposed on a top of the slip-on clip 33; a locating slot 341 is disposed at where appropriately on the slide plate 34; the locating slot 341 is externally inserted onto a locating plate 342; and both of the locating plate 342 and the guide plate 31 are properly secured in the selection unit 2. A connection cord 35 and a selection plate set 36 are disposed on the extension rod 11. The connection cord includes a first end 351 and a second end 352; the selection plate set 36 is comprised of multiple selection plates 363, wherein they include a head selection plate 361 and a terminal selection 362. The terminal selection plate 362 and a certain portion of those selection plates 363 are arranged on the guide plate 31 at where between both rails 32 and are capable of sliding to travel; and the head selection plate 361 and certain portion of selection plates 361 are arranged in the space between the top of the extension rod 11 and a lower edge of the guide plate 31 to travel by sliding. The selection set 36 approximately indicate a C shaped arrangement; and an axis 360 is each disposed among the head selection plate 361, the terminal selection plate 362; and each of those selection plates 363 of the selection plate set 36 for changing abutted angle among those selection plates of the selection plate set 36. The head selection plate 361 in conjunction with the second end 352 of the connection cord 35 is connected at where appropriately to a bottom of the slip-on clip while the terminal selection plate 362 is incorporated to the first end 351 of the connection cord 35. Accordingly, both of the connection cord 35 and the selection plate set 36 jointly define an integral loop. Whereas the bottom of the slip-on clip, the connection rod 35, and the selection plate set 36 are linking to one another, the slip-on clip 33 travels as the slide plate 34 moves so to further drive the connection cord 35 and the selection plate set 36 to move. A gap 311 is disposed to the guide plate 31 to receive and locate the connection cord 35.

The slide plate 34 may be exposed out of the chute 21 of the selection unit 2; and multiple ribs 22 are disposed at where appropriately in the chute 21 for moving and then locating the slide plate 34 in position.

As illustrated in FIG. 2, an opening 41 is disposed in the center of the weight plate 4 to accommodate the extension rod 11; and a corresponding locking hole 42 is separately disposed at where appropriately to the weight plate 4 to receive insertion of the selection plate set 36. The weight plate 4 inserted into the locking hole 42 by the selection plate set 36 is attached to the selection mechanism and forms a connection with the selection mechanism 3.

Multiple channels 51 are disposed at where appropriately on the base 5 with each channel to allow storage of the weight plate 4 in its erected status.

In practice, all weight plates 4 are placed in their corresponding channels on the base 5 with the opening 41 of each weight plate 4 facing up; both of the handle unit 1 and the selection unit 2 are placed on each and all weight plates 4 to permit the extension rod to fall into those openings 41; and the slide plate 34 is pushed to drive the slip-on clip, the connection cord 35, and the selection plate set 36 to travel for the selection plate set to enter into those locking holes 42 of all the weight plates 4 as illustrated in FIG. 2 so to allow select any and all weight plates to be attached to the dumbbell. Once the handle unit 1 is lifted up to clear of the base 5, all the weight plates 4 and the handle unit 1 are connected into an integrated part without falling off.

Figure 5:
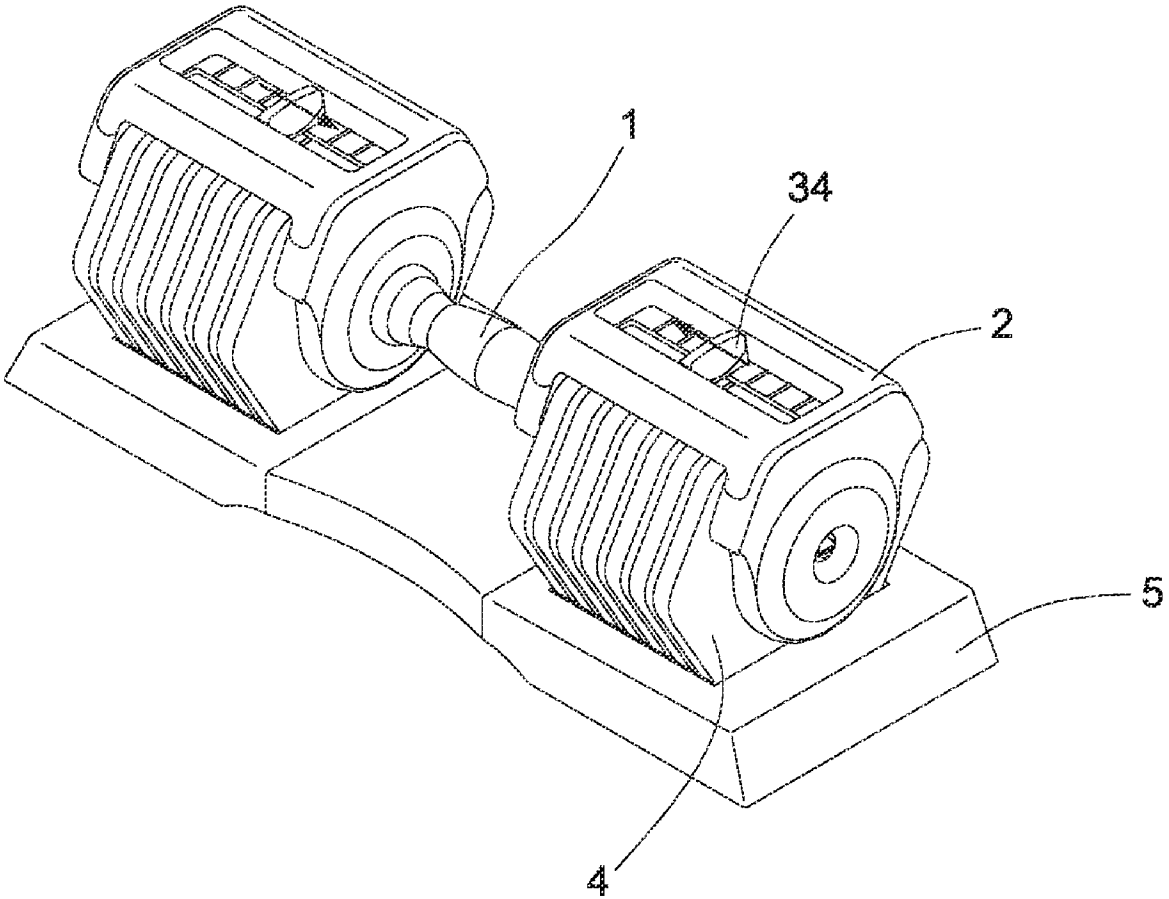
FIG. 5 is a perspective view showing weight adjustment of the present invention.
Figure 6:
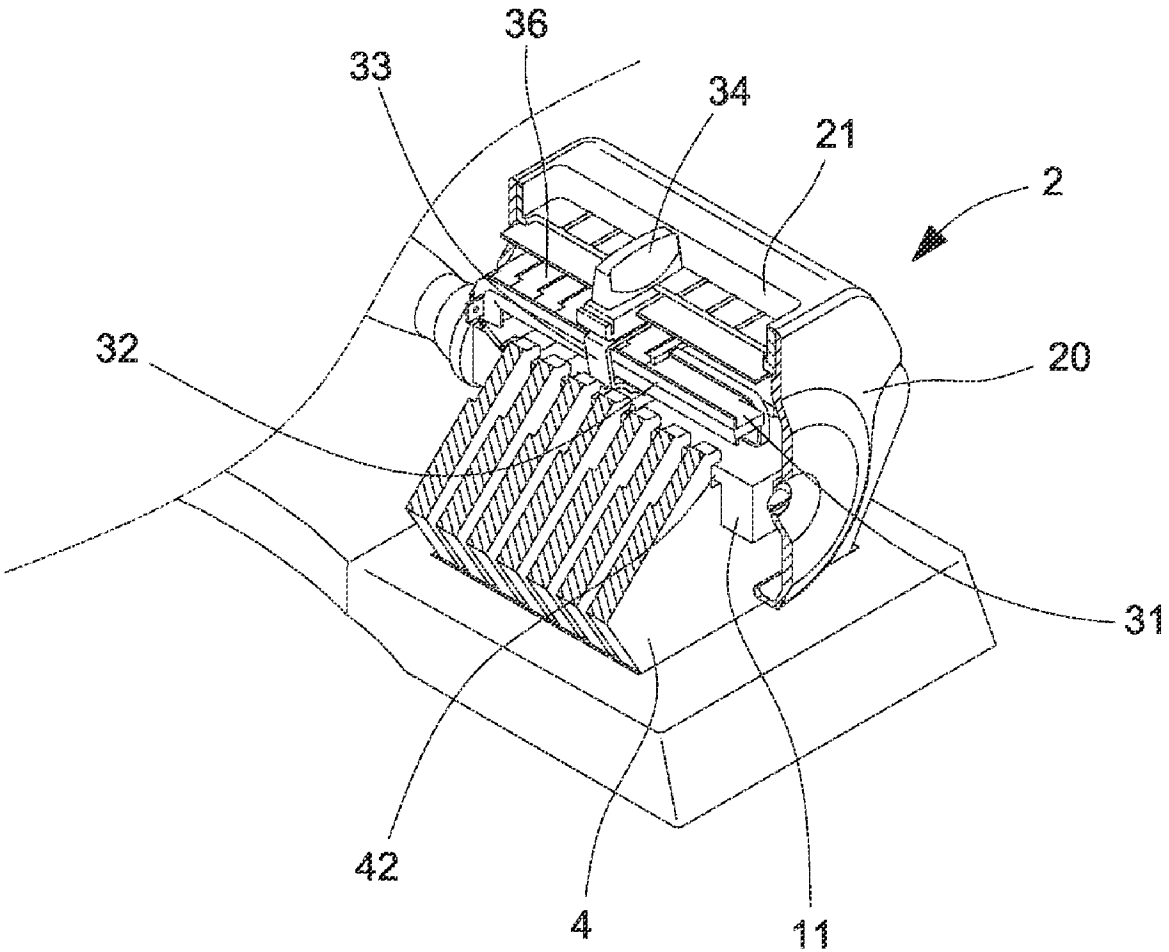
FIG. 6 is a sectional view showing a local part during weight adjustment of the present invention.
Figure 7:
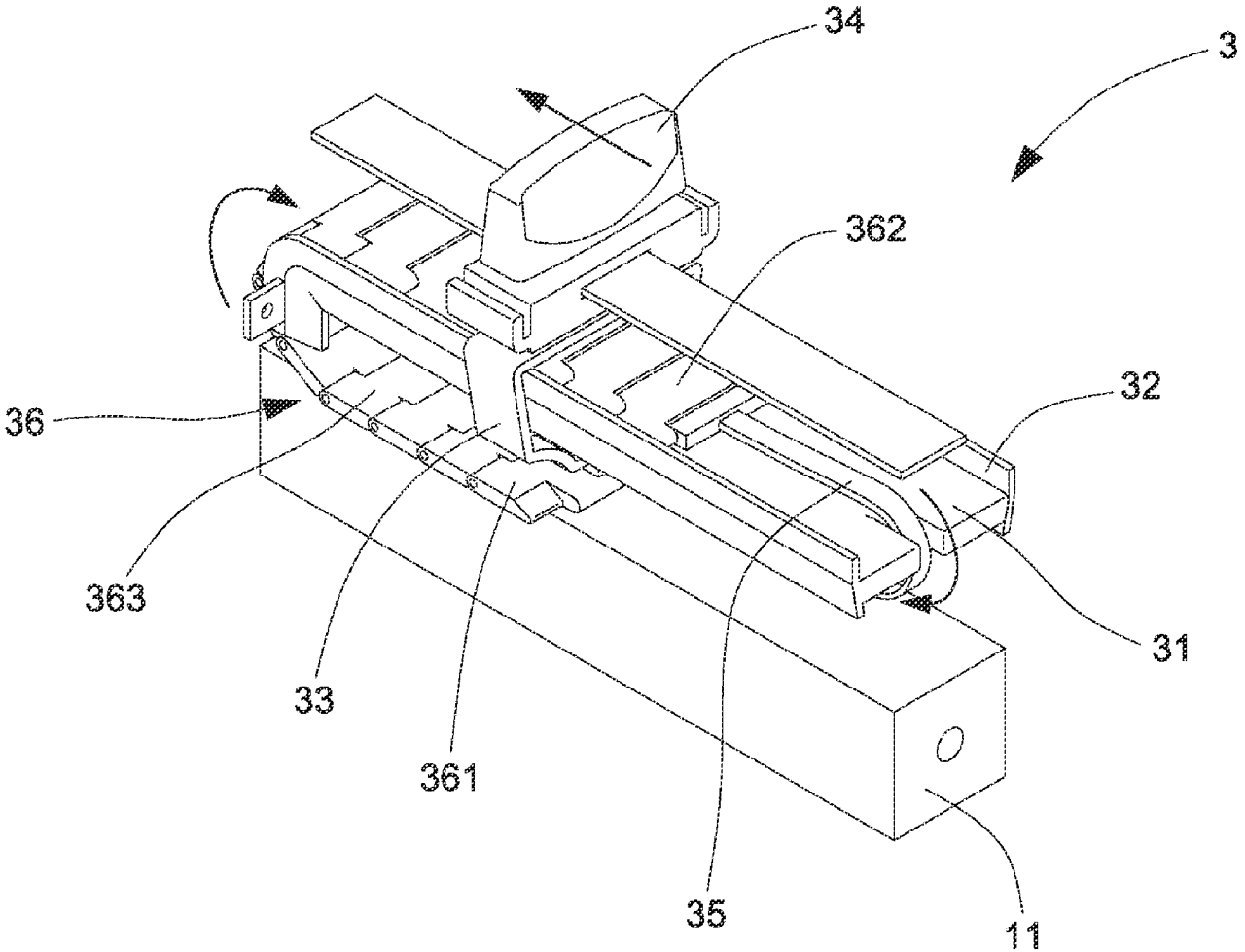
FIG. 7 is a perspective view of the selection mechanism during weight adjustment of the present invention.
Figure 8:
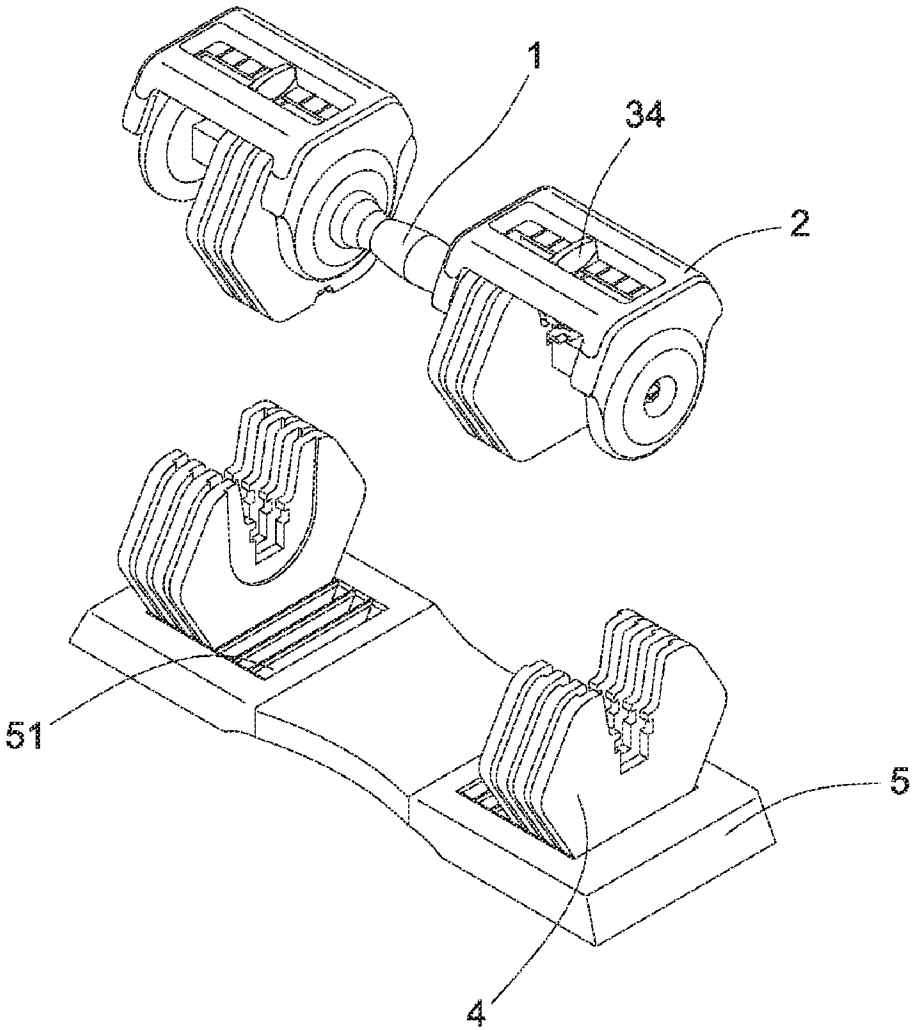
FIG. 8 is a schematic view showing another operating status of the present invention.

To adjust the quantity of the weight plates 4 to be attached to the dumbbell for achieving the purpose of adjusting the overall weight of the dumbbell, more the slide plate 34 in the direction facing the end of the handle unit 1 as illustrated in FIGS. 5, 6, and 7, the slip-on clip is linked to drive both of the connection cord 35 and the selection plate set 36 to travel, a certain portion of the selection plate set 36 otherwise secured in corresponding locking holes of those weight plates 4 will exit from their locking holes 42 so that only certain portion of those weight plates 44 are attached to the selection plate set 36; again, when the handle unit 1 is lifted up to clear away from the base 5 as illustrated in FIG. 8, only those weight plates 4 selected will be attached to the selection plate set 36 to achieve the purpose of adjusting the overall weight of the dumbbell.

I claim:

1. A dumbbell weight selection structure comprising a portable handle unit comprising an extension rod extending from two opposite ends thereof, a selection unit comprising a selection mechanism respectively fixed on the extension rods, and a plurality of weight plates, wherein the selection mechanism comprises a movable selection plate set; and each weight plate comprises an opening and a locking opening, and wherein the opening and the locking opening comprise a common receiving opening to receive the extension rod and the selection mechanism, and when the selection plate set of the selection mechanism is moved and inserted into the locking opening, the weight plates are locked onto the selection mechanism and the handle unit, and when the selection plate set is released from the locking opening, the weight plates are released from the selection mechanism and the handle unit, wherein the selection plate set is comprised of multiple selection plates, wherein each selection plate of the selection plate set is pivotally attached to the selection plate set.

2. The dumbbell weight selection structure as claimed in claim 1, wherein the selection unit includes a casing; a chute is disposed on the casing; and the selection mechanism is disposed on the chute.

3. The dumbbell weight selection structure as claimed in claim 2, wherein a guide plate is further disposed on the selection mechanism; two rails are respectively disposed on both sides of the guide plate; a slip-on clip is externally disposed on the rails; a slide plate is connected to the slip-on clip; and the slip-on clip is further connected to a connection cord and the selection plate set.

4. The dumbbell weight selection structure as claimed in claim 1, wherein an axis is disposed among each selection plate.

5. The dumbbell weight selection structure as claimed in claim 3, wherein the slide plate, the slip-on clip, the connection cord, and the selection plate set are linked to each other.

6. The dumbbell weight selection structure as claimed in claim 3, wherein a locating slot is disposed on the slide plate; and the locating slot is externally inserted onto a locating plate.

7. The dumbbell weight selection structure as claimed in claim 1, wherein the extension rod and the selection plate set form a loop.

8. The dumbbell weight selection structure as claimed in claim 3, wherein the slide plate is exposed out of the chute.

9. The dumbbell weight selection structure as claimed in claim 8, wherein multiple ribs are disposed on the chute.

10. The dumbbell weight selection structure as claimed in claim 3, wherein a gap is disposed on the guide plate, and the gap accommodates and secures the connection cord in position.

11. The dumbbell weight selection structure as claimed in claim 1, wherein a number of selection plates correspond to a number of the weight plates to be locked onto the selection set.

12. The dumbbell weight selection structure as claimed in claim 11, wherein a number of the selection plates can be adjusted.

* * * * *